US006259420B1

(12) United States Patent
Bengtsson et al.

(10) Patent No.: US 6,259,420 B1
(45) Date of Patent: Jul. 10, 2001

(54) ANTENNA ELEMENT WITH HELICAL RADIATION MEMBERS

(75) Inventors: Pär Bengtsson, Alingsås; Sven-Olof Brattström, Kållered, both of (SE)

(73) Assignee: Saab Ericsson Space AB, Göteborg (SE)

( * ) Notice: Subject to any disclaimer, the term of this patent is extended or adjusted under 35 U.S.C. 154(b) by 0 days.

(21) Appl. No.: 09/380,466

(22) PCT Filed: Feb. 12, 1998

(86) PCT No.: PCT/SE98/00245

§ 371 Date: Sep. 20, 1999

§ 102(e) Date: Sep. 20, 1999

(87) PCT Pub. No.: WO98/39816

PCT Pub. Date: Sep. 11, 1998

(30) Foreign Application Priority Data

Mar. 3, 1997 (SE) ..... 9700740

(51) Int. Cl.[7] ..... H01Q 1/36
(52) U.S. Cl. ..... 343/895; 343/700 MS
(58) Field of Search ..... 343/895, 700 MS, 343/845, 846, 847, 848

(56) References Cited

U.S. PATENT DOCUMENTS

| | | | | |
|---|---|---|---|---|
| 2,184,940 | * | 12/1939 | Cork et al. | 250/33 |
| 3,188,643 | | 6/1965 | Dyson et al. | 343/895 |
| 3,836,979 | * | 9/1974 | Kurland et al. | 343/881 |
| 5,346,300 | | 9/1994 | Yamamoto et al. | 343/895 |
| 5,349,365 | | 9/1994 | Ow et al. | 343/895 |
| 6,011,524 | * | 1/2000 | Jervis | 343/895 |

FOREIGN PATENT DOCUMENTS

| | | |
|---|---|---|
| 0465658 | 1/1992 | (EP) . |
| WO 94/21005 | 9/1994 | (WO) . |

* cited by examiner

*Primary Examiner*—Tan Ho
*Assistant Examiner*—Tuyet T. Vo
(74) *Attorney, Agent, or Firm*—Swidler Berlin Shereff Friedman LLP

(57) ABSTRACT

An antenna element for circular polarization comprising a ground plane with first to fourth radiation members in the form of helical wires symmetrically arranged around a symmetry axis. The antenna element further comprises a distribution network arranged below the ground plane. Outer lower ends of the radiation members are attached in a supporting manner, electrically conducting, to the ground plane. Upper ends of the radiation members face away from the ground plane and are electrically interconnected.

1 Claim, 1 Drawing Sheet

ANTENNA ELEMENT WITH HELICAL RADIATION MEMBERS

BACKGROUND OF THE INVENTION

The present invention relates to an antenna element for circular polarization comprising a ground plane, with first to fourth radiation members in the form of helical wires, symmetrically arranged around a symmetry axis, as well as a distribution network arranged below the ground plane.

Such antenna elements are known, with cylindrical or conical arrangement of the radiation members. These are fixed in space by winding them on some substrate of dielectric material, or by etching them on a substrate, which is then formed, usually into a cylinder.

The substrate, which usually consists of a polymer, may give rise to electrostatic discharges, which is a problem as far as a space application is concerned. The discharges may also cause problems in the amplifier stages of the connected receiver.

Thus, there is a need of an antenna element of the kind mentioned in the introduction, which does not exhibit the above-mentioned disadvantages.

SUMMARY OF THE INVENTION

According to the invention, such an antenna element is characterized in that the radiation members in their outer lower ends are attached in a supporting manner, electrically conducting, to the ground plane, and in that the radiation members in their upper ends, facing away from the ground plane, are electrically interconnected.

In a preferred embodiment, each of the radiation members is connected to the distribution network at a point at the distance $\lambda/4$ from its outer, lower end.

BRIEF DESCRIPTION OF THE DRAWINGS

The invention will be described in the following with reference to the accompanying schematic perspective drawing, wherein.

Figure 1:
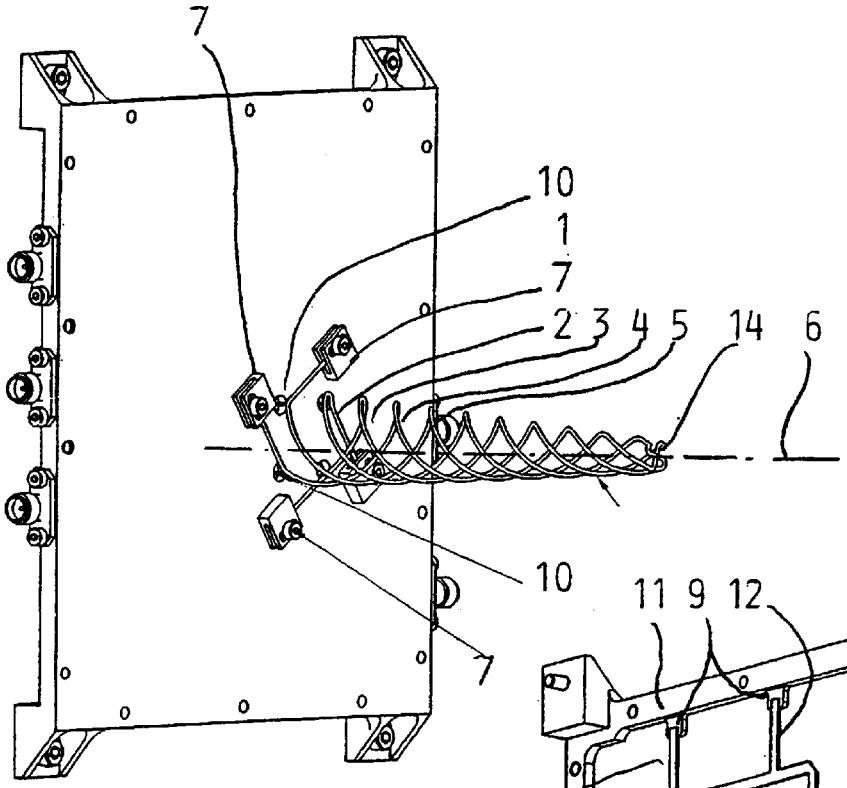
FIG. 1 shows an embodiment of the antenna element, viewed from above.
Figure 2:
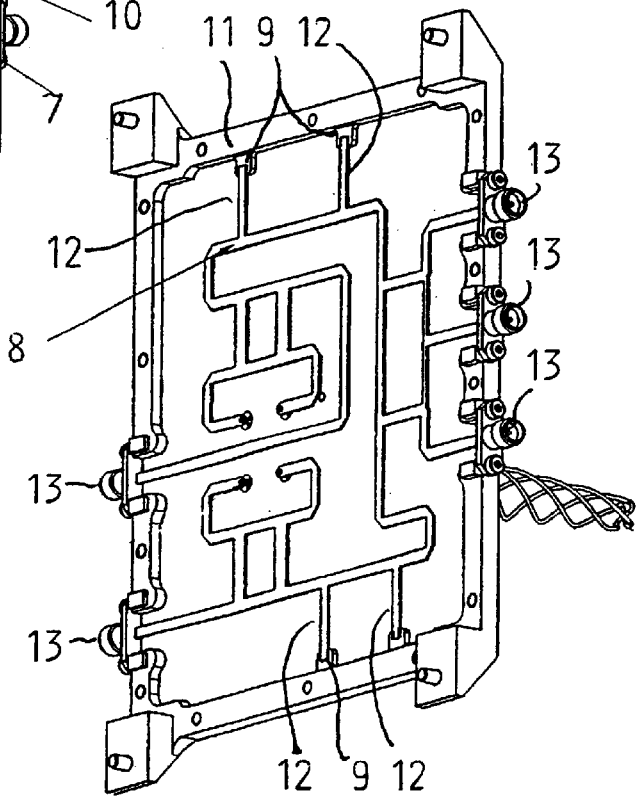
FIG. 2 shows the same object, viewed from below.

In the figures, a first ground plane is designated 1. First to fourth radiation members, in the form of four helical metal wires 2–5, are arranged symmetrically around a symmetry axis 6 such that they may be circumscribed by a cone. In their outer, lower ends, the wires are attached via metal plates 7, in electrical contact with the first ground plane 1. In the upper ends, the wires are electrically interconnected. Below the first ground plane, a distribution network 8 is arranged, suspended from fastening devices 9. The radiation members are each, at the distance $\lambda/4$ from their lower ends, for the fourth radiation member 5 marked by 10, connected to the distribution network 8. In this way, all energy supplied to the radiation members will be radiated out from these.

Figure 3:
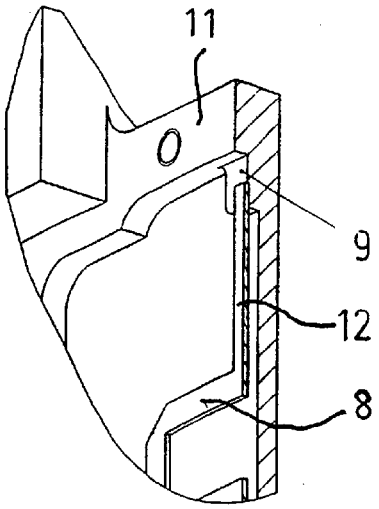
FIG. 3 shows a detail, partly in cross section, of the attachment of a distribution network.

As is most clearly shown in FIG. 3, the fastening devices 9 consist of stages in a frame 11, arranged in the circumference of the first ground plane 1. The distribution network is provided with four pieces of conductor 12, which are each placed against a corresponding fastening device 9, and are squeezed against this by a second ground plane (not shown). The pieces of conductor exhibit the length $\lambda/4$, whereby they serve as open conductors as viewed from the distribution network. The advantage of this arrangement is that it is not necessary to use fastening devices of some insulating material, such as polymers. The distribution network feeds and receives signals, respectively, via inputs/outputs 13.

What is claimed is:

1. An antenna element for circular polarization, comprising:

a ground plane;

a distribution network arranged below said ground plane; and four radiation members in the form of helical wires having upper and lower ends, said helical wires being symmetrically arranged around a symmetry axis perpendicular to said ground plane;

wherein:

said upper ends are electrically interconnected away from said ground plane; and said lower ends are connected in a supporting manner, electrically conducting, to said ground plane at first points, and connected to said distribution network at second points a distance $\lambda/4$ from said first points.

* * * * *